US008952617B2

(12) United States Patent
Hui et al.

(10) Patent No.: US 8,952,617 B2
(45) Date of Patent: Feb. 10, 2015

(54) PASSIVE LC BALLAST AND METHOD OF MANUFACTURING A PASSIVE LC BALLAST

(75) Inventors: Ron Shu Yuen Hui, Shatin (HK); Wai Man Ng, Kwai Chung (HK); Deyan Lin, Hung Hom (HK)

(73) Assignee: City University of Hong Kong, Hong Kong (HK)

( * ) Notice: Subject to any disclaimer, the term of this patent is extended or adjusted under 35 U.S.C. 154(b) by 261 days.

(21) Appl. No.: 13/505,835

(22) PCT Filed: Nov. 3, 2009

(86) PCT No.: PCT/IB2009/007289
§ 371 (c)(1),
(2), (4) Date: Dec. 20, 2012

(87) PCT Pub. No.: WO2011/055158
PCT Pub. Date: May 12, 2011

(65) Prior Publication Data

US 2013/0106300 A1 May 2, 2013

(51) Int. Cl.

| | |
|---|---|
| ***H05B 41/36*** | (2006.01) |
| ***H05B 41/24*** | (2006.01) |
| ***H05B 41/295*** | (2006.01) |
| ***H05B 41/02*** | (2006.01) |
| *H01F 38/10* | (2006.01) |

(52) U.S. Cl.
CPC ..... *H05B 41/24* (2013.01); *H05B 41/295* (2013.01); *H05B 41/02* (2013.01); *H05B 41/245* (2013.01); *H01F 38/10* (2013.01)
USPC ..... 315/152; 315/291; 315/82; 315/88; 315/362

(58) Field of Classification Search
CPC ..... H05B 41/36; G05I 1/00
USPC ..... 315/152, 291, 200 R, 82, 88, 362; 320/166; 340/641
See application file for complete search history.

(56) References Cited

U.S. PATENT DOCUMENTS

| | | | | |
|---|---|---|---|---|
| 5,416,387 | A * | 5/1995 | Cuk et al. | 315/209 R |
| 5,469,028 | A * | 11/1995 | Nilssen | 315/291 |
| 5,493,180 | A * | 2/1996 | Bezdon et al. | 315/91 |
| 5,841,241 | A | 11/1998 | Nilssen | |
| 6,459,213 | B1 * | 10/2002 | Nilssen | 315/224 |
| 6,479,949 | B1 * | 11/2002 | Nerone et al. | 315/291 |

(Continued)

FOREIGN PATENT DOCUMENTS

| | | | |
|---|---|---|---|
| CN | 101056491 | A | 10/2007 |
| EP | 0852453 | A1 | 7/1998 |
| JP | 2008192318 | A | 8/2008 |

*Primary Examiner* — Douglas W Owens
*Assistant Examiner* — Wei Chan
(74) *Attorney, Agent, or Firm* — Renner Kenner Greive Bobak Taylor & Weber

(57) ABSTRACT

The present invention provides a passive LC ballast and an associated method of manufacturing a passive LC ballast for use with any one of a plurality of high voltage discharge lamps. The passive LC ballast has an inductance and a capacitance selected in accordance with one of a set of one or more inductance-capacitance pairs. Each inductance-capacitance pair defines a respective inductance and a respective capacitance such that, when the inductance and the capacitance of the passive LC ballast is selected in accordance with any one of the inductance-capacitance pairs and the passive LC ballast is used with any one of the lamps, the lamp operates between respective minimum and maximum lamp powers of the lamp.

22 Claims, 5 Drawing Sheets

(56) References Cited

U.S. PATENT DOCUMENTS

| | | | | |
|---|---|---|---|---|
| 6,936,973 | B2 * | 8/2005 | Parra et al. | 315/209 R |
| 7,355,354 | B2 * | 4/2008 | Rust et al. | 315/291 |
| 7,420,335 | B2 * | 9/2008 | Robinson et al. | 315/224 |
| 7,443,107 | B2 * | 10/2008 | Shannon et al. | 315/224 |
| 7,564,191 | B2 * | 7/2009 | Chang et al. | 315/209 R |
| 7,742,318 | B2 * | 6/2010 | Fu et al. | 363/16 |
| 7,880,397 | B2 * | 2/2011 | Rust et al. | 315/224 |
| 8,164,280 | B2 * | 4/2012 | Park et al. | 315/311 |
| 2002/0047601 | A1 * | 4/2002 | Shannon et al. | 315/224 |
| 2003/0085669 | A1 * | 5/2003 | Pak | 315/224 |
| 2005/0035729 | A1 * | 2/2005 | Lev et al. | 315/291 |
| 2008/0252224 | A1 * | 10/2008 | Yu et al. | 315/209 R |
| 2010/0026479 | A1 * | 2/2010 | Tran | 340/501 |
| 2010/0072909 | A1 * | 3/2010 | O'Gorman et al. | 315/246 |
| 2010/0206295 | A1 * | 8/2010 | Xiang et al. | 126/601 |
| 2010/0270015 | A1 * | 10/2010 | Vinegar et al. | 166/272.1 |
| 2010/0320924 | A1 * | 12/2010 | Beij | 315/224 |
| 2011/0291491 | A1 * | 12/2011 | Lemmens et al. | 307/104 |
| 2011/0316444 | A1 * | 12/2011 | Terasaka et al. | 315/294 |
| 2012/0175967 | A1 * | 7/2012 | Dibben et al. | 307/104 |

* cited by examiner

PASSIVE LC BALLAST AND METHOD OF MANUFACTURING A PASSIVE LC BALLAST

FIELD OF THE INVENTION

The present invention relates to ballasts for discharge lamps, particularly, but not exclusively, passive ballasts. The invention is herein described for use with high voltage discharge lamps, but it will be appreciated that the invention is not limited to this particular use.

BACKGROUND OF THE INVENTION

Presently, only electronic ballasts are commercially available for T5 fluorescent lamps. This is because conventional passive magnetic ballasts operating at AC mains of 220-240V may not provide enough voltage to sustain the high lamp voltages of T5 lamps with rated powers equal to or higher than 28 W. Electronic ballasts, on the other hand, can provide high ignition voltages using resonant tanks and then provide constant lamp power operation, as well as end-of-life detection and protection functions.

However, electronic ballasts have relatively high power loss and relatively low energy efficiency, especially when used with high-voltage low-current lamps, such as T5 lamps. Existing electronic ballasts also have typical lifetimes of five years and contain toxic/non-biodegradable components.

For countries with 110V mains, the typical practice for controlling high-voltage discharge lamps is to use a step-up transformer to increase the AC voltage for driving the lamps. However, this approach is not only more costly, but also further reduces the energy efficiency of the lighting system. Electronic starters with end-of-life detection functions (e.g. UM2 electronic starters from Tabelek Control System Ltd., UK) have been developed to ignite high-voltage discharge lamps. For 220-240V mains, passive LC (inductive-capacitive) magnetic ballasts have been previously proposed in the lighting industry.

However, LC magnetic ballasts are not available commercially for T5 lamps. One reason is that it is difficult to optimize the values of the inductor and capacitor required for rated power operation of lamps. Also, there is still a misconception that electronic ballasts are always more energy-efficient than magnetic ballasts.

More particularly, there is no magnetic ballast commercially available for high-voltage lamps such as T5 28 W and T5 35 W lamps. T5 28 W lamps have on-state voltages of about 165V at high-frequency operation and about 180V at mains frequency operation. These voltage levels are so close to the 220V-240V AC mains that the voltage difference may not be able to sustain the lamp arc, in view of the vectorial relationships of the AC mains voltage, the voltage drop across the ballast and the lamp voltage.

It is an object of the present invention to overcome or ameliorate at least one of the disadvantages of the prior art, or to provide a useful alternative.

SUMMARY OF THE INVENTION

In a first aspect, the present invention provides a passive LC ballast for use with a high voltage discharge lamp, the passive LC ballast having an inductance and a capacitance in accordance with a non-linear model such that the lamp operates at a predetermined lamp power, the inductance and the capacitance thereby defining an inductance-capacitance pair.

In a second aspect, the present invention provides a method of manufacturing a passive LC ballast for use with a high voltage discharge lamp, the method including providing the passive LC ballast with an inductance and a capacitance calculated using a non-linear model such that the lamp operates at a predetermined lamp power, the inductance and the capacitance thereby defining an inductance-capacitance pair.

The following features apply to both the first and second aspects.

Preferably, the non-linear model is based on the following equations:

$$\frac{dT_e}{dt} = a_1(i^2R - P_{con} - P_{rad});$$

$$P_{rad} = a_2\exp(-ea_3/kT_e);$$

$$P_{con} = a_4(T_e - T_0);$$

$$R = a_5T_e^{-3/4}\exp(ea_6/2kT_e);$$

$$V(t) = a_7L\frac{di}{dt} + i(R + r) + V_c + v_{ele};$$

and $$\frac{dV_c}{dt} = \frac{i}{C};$$

wherein:

$T_e$ is the electron temperature;
i is the lamp current;
R is the lamp resistance;
$P_{con}$ is the thermal conduction loss in the lamp;
$P_{rad}$ is the radiation loss in the lamp;
$T_0$ is the tube temperature;
k is the Boltzmann constant;
e is the charge on an electron;
V(t) is the power supply voltage;
L is the ballast inductance;
C is the ballast capacitance;
r is the ballast resistance;
$V_{ele}$ is the electrode voltage drop in the lamp;
$V_c$ is the voltage across the capacitor in the LC ballast; and
$a_1$ to $a_7$ are unknown coefficients.

Preferably, the non-linear model is based on equations having unknown coefficients, and the unknown coefficients are in accordance with an evolutionary algorithm. Preferably, the evolutionary algorithm is a genetic algorithm.

Preferably, a plurality of the inductance-capacitance pairs are in accordance with the non-linear model, the inductance and the capacitance being one of the inductance-capacitance pairs such that the lamp operates at the predetermined lamp power.

Preferably, the predetermined lamp power is any one of the lamp powers between a minimum lamp power and a maximum lamp power, a plurality of the inductance-capacitance pairs are thereby in accordance with the non-linear model, the inductance and capacitance being one of the inductance-capacitance pairs such that the lamp operates between the minimum and maximum lamp powers.

Preferably, a plurality of sets of the inductance-capacitance pairs are in accordance with the non-linear model with each set corresponding to one of the lamp powers between the minimum and maximum lamp powers, the inductance and capacitance being one of the inductance-capacitance pairs such that the lamp operates between the minimum and maximum lamp powers.

In one embodiment, the lamp has a rated lamp power, the minimum lamp power being about 90% of the rated lamp power and the maximum lamp power being about 110% of the rated lamp power. In another embodiment, the lamp has a rated lamp power, the minimum lamp power being about 95% of the rated lamp power and the maximum lamp power being about 100% of the rated lamp power.

In one embodiment, the passive LC ballast is for use with any one of a plurality of the high voltage discharge lamps, the minimum and maximum lamp powers of the lamps defining one or more common inductance-capacitance pairs, the inductance and the capacitance being one of the common inductance-capacitance pairs such that, when the passive LC ballast is used with any one of the lamps, the lamp operates between the respective minimum and maximum lamp powers of the lamp.

In another embodiment, the passive LC ballast is for use with a plurality of the high voltage discharge lamps interconnected in series, each lamp operating at respective individual predetermined lamp powers, the sum of which equals the predetermined lamp power.

Preferably, the lamp is a T5 fluorescent lamp. Also preferably, the lamp has a rated power of one of 14 W, 21 W, 28 W and 35 W. More preferably, the lamp is a T5 fluorescent lamp with a rated power of one of 14 W, 21 W, 28 W and 35 W.

In one embodiment, the plurality of lamps includes lamps having different respective minimum and maximum lamp powers.

In another embodiment, the plurality of lamps includes lamps each having a different respective rated lamp power and respective minimum and maximum lamp powers proportional to the respective rated lamp power. Preferably, the different rated lamp powers are two or more of 14 W, 21 W, 28 W and 35 W. More preferably, the plurality of lamps includes four lamps having rated lamp powers of 14 W, 21 W, 28 W and 35 W respectively. Preferably, the lamps are T5 fluorescent lamps.

Preferably, the passive LC ballast includes an inductor having the inductance referred to above. Also preferably, the passive LC ballast includes a capacitor having the capacitance referred to above.

In a third aspect, the present invention provides a passive LC ballast for use with any one of a plurality of high voltage discharge lamps each having a respective minimum lamp power and a respective maximum lamp power, the passive LC ballast having an inductance and a capacitance selected in accordance with one of a set of one or more inductance-capacitance pairs, each inductance-capacitance pair defining a respective inductance and a respective capacitance such that, when the inductance and the capacitance of the passive LC ballast is selected in accordance with any one of the inductance-capacitance pairs and the passive LC ballast is used with any one of the lamps, the lamp operates between the respective minimum and maximum lamp powers of the lamp.

In a fourth aspect, the present invention provides a method of manufacturing a passive LC ballast for use with any one of a plurality of high voltage discharge lamps each having a respective minimum lamp power and a respective maximum lamp power, the passive LC ballast having an inductance and a capacitance, and the method including providing a set of one or more inductance-capacitance pairs, each inductance-capacitance pair defining a respective inductance and a respective capacitance such that, when the inductance and the capacitance of the passive LC ballast is selected in accordance with any one of the inductance-capacitance pairs and the passive LC ballast is used with any one of the lamps, the lamp operates between the respective minimum and maximum lamp powers of the lamp.

The following features apply to both the third and fourth aspects.

In one embodiment, the plurality of lamps includes lamps having different respective minimum and maximum lamp powers.

In another embodiment, the plurality of lamps includes lamps each having a different respective rated lamp power and respective minimum and maximum lamp powers proportional to the respective rated lamp power. Preferably, the different rated lamp powers are two or more of 14 W, 21 W, 28 W and 35 W. More preferably, the plurality of lamps includes four lamps having rated lamp powers of 14 W, 21 W, 28 W and 35 W respectively. Preferably, the lamps are T5 fluorescent lamps.

In one embodiment, the respective minimum lamp power of each lamp is about 90% of the respective rated lamp power and the respective maximum lamp power of each lamp is about 110% of the respective rated lamp power. In another embodiment, the respective minimum lamp power of each lamp is about 95% of the respective rated lamp power and the respective maximum lamp power of each lamp is about 100% of the respective rated lamp power.

Preferably, the set of inductance-capacitance pairs is in accordance with a non-linear model. Preferably, the non-linear model in these third and fourth aspects of the invention is the non-linear model of the first and second aspects described above.

Preferably, the non-linear model is based on equations having unknown coefficients, and the unknown coefficients are in accordance with an evolutionary algorithm. Preferably, the evolutionary algorithm is a genetic algorithm.

BRIEF DESCRIPTION OF THE FIGURES

Preferred embodiments in accordance with the best mode of the present invention will now be described, by way of example only, with reference to the accompanying figures, in which.

DETAILED DESCRIPTION OF THE BEST MODE OF THE INVENTION

Referring to the figures, a passive LC ballast 1 has an inductance 2 and a capacitance 3 in accordance with a non-linear model such that a lamp 4 operates at a predetermined lamp power, the inductance and the capacitance thereby defining an inductance-capacitance pair.

In another aspect, the invention provides a method of manufacturing a passive LC ballast, a preferred embodiment of which is a method of manufacturing the passive LC ballast 1. This embodiment includes providing the passive LC ballast 1 with the inductance 2 and the capacitance 3 calculated using the non-linear model such that the lamp 4 operates at a predetermined lamp power.

In preferred embodiments, the present invention is about the optimal design of LC (inductor-capacitor) ballasts for the optimal operation of high-voltage lamps, such as T5 21 W, 28 W and 35 W discharge lamps. However, it will be appreciated that the invention can be used with other voltage ratings and other types of lamps, such as T5-14 W lamps. Preferred embodiments allow the selection of circuit parameters with some degrees of tolerance without affecting the lamp power significantly. For example, some embodiments maintain lamp power within a tight tolerance, whilst allowing capacitance values to vary from typically 2% to 25%, that is, allowing tolerances of the circuit components that are not negligible.

Figure 1:
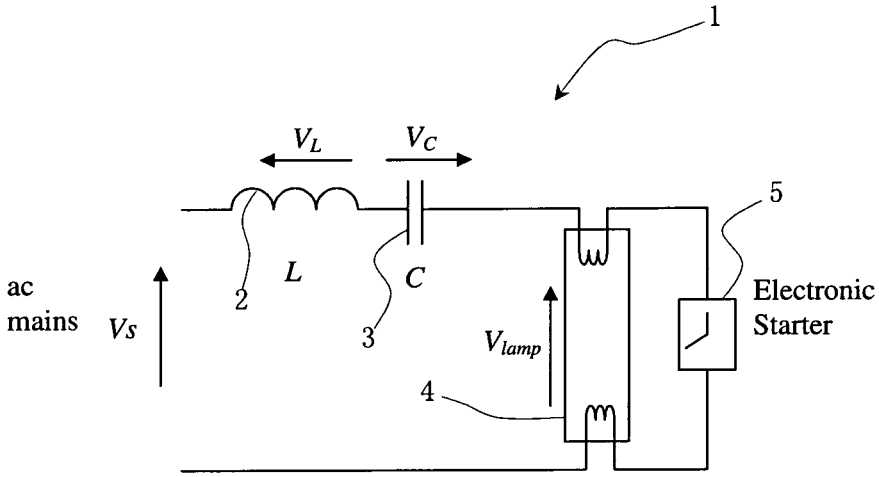
FIG. 1 is a circuit diagram of a typical circuit for an LC (inductive-capacitive) resonant ballast.

A typical resonant ballast circuit using an electronic starter 5 is shown in FIG. 1. The resonant circuit simply consists of an inductor (L) and a capacitor (C), and can be referred to as "an LC ballast". The methods and apparatuses of present invention can be applied to such a circuit.

Due to the opposite polarities of the voltage vectors across the series-connected inductor and capacitor, the voltage drop across the inductor in a circuit such as that in FIG. 1 can be partially or totally cancelled by the voltage across the capacitor. This results in the feasibility of driving high-voltage lamps, such as T5 28 W and 35 W lamps, with a standard 220-240V mains without using electronic ballasts.

Various electronic starters can be used to turn on a fluorescent lamp driven by this LC ballast. The electronic starter provides an initial preheating current to warm up the filament. When the filament temperature reaches an appropriate level, at which the filament resistance increases by 4 to 5 times of its value at room temperature, the electronic starter will cut off the preheat current. The large change of inductor current induces a high voltage (due to the large $v_L$=Ldi/dt) that will appear across the lamp for ignition.

After ignition, the switch in the starter is turned off. The resonant circuit provides a boosted voltage to ensure that sufficient voltage is available for sustaining the lamp arc. Since the voltage across the inductor and the voltage across the capacitor are 180 degrees out of phase, the voltage vector drop across the inductor is partially cancelled by the voltage vector drop across the capacitor. Consequently, more voltage is available to sustain the lamp arc voltage.

Figure 2:
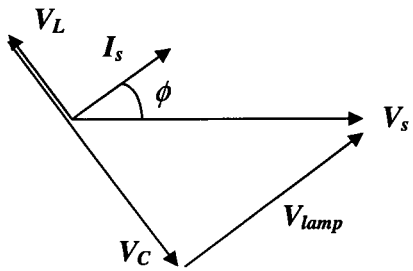
FIG. 2 is a vector diagram of the electrical properties of the circuit of FIG. 1.

The traditional method for analyzing a circuit, such as that shown in FIG. 1, in order to select circuit components, such as inductors and capacitors, for optimal operation is to use circuit vectors (or a phasor diagram) to relate the voltage and current vector components in the circuit. FIG. 2 shows a typical vector diagram for the circuit of FIG. 1. In FIG. 2, $V_S$, $V_L$, $V_C$ and $V_{lamp}$ refer to voltage vectors for the AC mains voltage, inductor voltage, capacitor voltage and lamp voltage, respectively. From FIG. 2, it can been seen that the displacement angle between the input current $I_s$ and the AC mains voltage $V_S$ is $\phi$. The power factor of this system is therefore:

$$\cos(\phi) = \frac{V_{lamp}}{V_S} \tag{1}$$

For an AC mains of 230V and a T5 28 W lamp with an on-state lamp voltage of typically 167V, this power factor is about 0.72.

Based on the following parameters, a linear vectorial analysis has been performed for T5 28 W and 35 W lamps.

Vectorial analysis with resistive lamp arc:

for 28 W lamp:

at 28 W:

lamp voltage: 181.48V
lamp current: 210 mA
lamp power: 28 W at 26.6 W:

lamp voltage: 183.7V
lamp current: 199 mA
lamp power: 26.6 W for 35 W lamp:

at 35 W:

lamp voltage: 235.51V
lamp current: 197 mA
lamp power: 35 W at 33.25 W:

lamp voltage: 232.97V
lamp current: 207 mA
lamp power: 33.25 W

Figure 3:
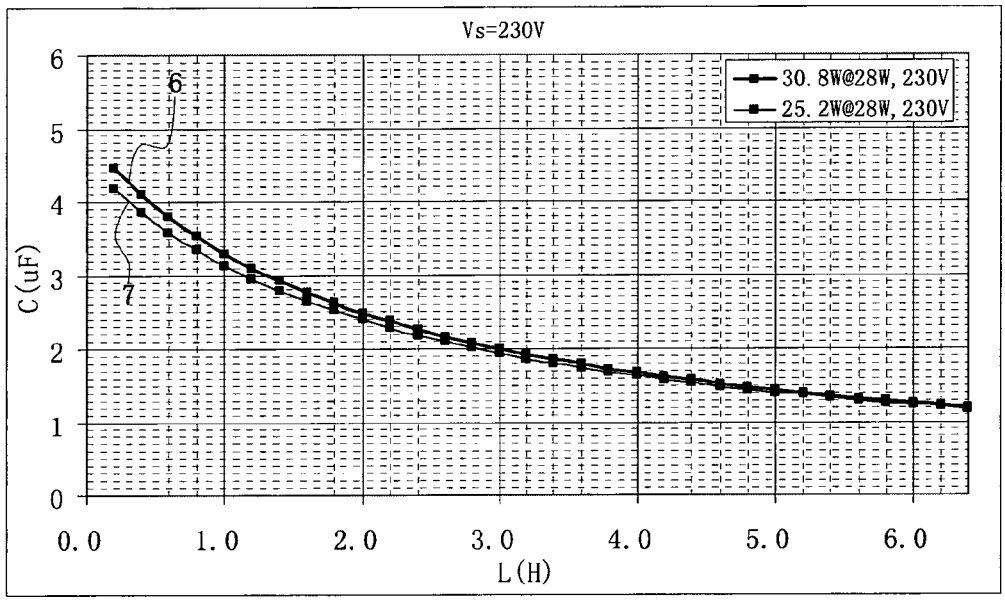
FIG. 3 is a graph showing the inductances and capacitances calculated for the lamp powers indicated using linear circuit analysis.

The optimal choice of inductor and capacitor values (L and C) is shown within the upper and lower curves 6 and 7 in FIG. 3 for 28 W lamps. The upper curve 6 denotes the points at which 110% (30.8 W) of the rated lamp power (28 W) occurs and the lower curve 7 denotes the points at which the lamp power is 90% (25.2 W) of the rated lamp power. The optimal choice of inductor and capacitor values is represented by each point within the upper and lower curves, each of which define an inductor value and a respective capacitor value, thereby defining an inductor-capacitor pair that satisfies the optimal choice.

It will be shown later that the traditional linear circuit analysis above does not provide accurate predictions. In fact, this linear circuit analysis method does not provide solutions for 35 W lamps since the high lamp voltage of T5 35 W lamps (>230V) is "theoretically" too close to the 230V AC mains. There is no scope for voltage drop across the ballast circuit. This is why traditional methods cannot lead to a practical solution for a passive LC ballast for T5 lamps. Therefore, these methods of circuit analysis mistakenly lead to the misconception that an LC ballast cannot be designed for T5 35 W lamps for a 230V AC mains.

Linear analysis models such as that described above suffer from one common problem, that is, the lamp voltage of the model at mains frequency is sinusoidal while the practical voltage at mains frequency is rectangular with an initial high voltage spike at the beginning of each half-cycle. Therefore, linear analysis methods such as that above lead to considerable errors.

Preferred embodiments of the present invention utilize non-linear models and analysis. These can accurately describe the non-linear behaviour of discharge lamps, such as T5 lamps. In the presently described preferred embodiment, a non-linear physical model based on the following physical equations containing seven coefficients or unknowns, $a_1$ to $a_7$, is utilized.

$$\frac{dT_e}{dt} = a_1(i^2R - P_{con} - P_{rad}) \quad (1)$$

$$P_{rad} = a_2\exp(-ea_3/kT_e) \quad (2)$$

$$P_{con} = a_4(T_e - T_0) \quad (3)$$

$$R = a_5T_e^{-3/4}\exp(ea_6/2kT_e) \quad (4)$$

$$V(t) = a_7L\frac{di}{dt} + i(R + r) + V_c + v_{ele} \quad (5)$$

$$\frac{dV_c}{dt} = \frac{i}{C} \quad (6)$$

In the above equations, $T_e$ is the electron temperature, i is the lamp current, R is the lamp resistance, $P_{con}$ is the thermal conduction loss in the lamp, $P_{rad}$ is the radiation loss in the lamp, $T_0$ is the tube temperature, k is the Boltzmann constant, e is the charge on an electron, V(t) is the power supply voltage, L is the ballast inductance, C is the ballast capacitance, r is the ballast resistance, $V_{ele}$ is the electrode voltage drop in the lamp and V, is the voltage across the capacitor in the LC ballast.

By measuring the external lamp voltage and current, these coefficients can be obtained from an evolutionary algorithm such as a genetic algorithm (GA). In particular, the parameters for each type of lamp can be obtained by feeding the measured lamp voltage and current data into the equations in an iterative manner. With the help of an evolutionary algorithm, such as a GA, the error function can be minimized so that the parameters $a_1$ to $a_7$ of each type of lamp can be obtained.

Based on this method, the parameters for T5-28 W and T5-35 W lamps have been calculated as follows:

Physical Model Analysis:

for 28 W lamp:

a1=45214.32145
a2=113466.0557
a3=3.414823989
a4=0.155876345
a5=1537.509178
a6=0.368481594
a7=1.377305482 for 35 W lamp:

a1=36807.87332
a2=60255.99031
a3=3.727534805
a4=0.155536939
a5=3861.95592
a6=0.336980825
a7=1.394452352

The predetermined lamp power can be any one of the lamp powers between a minimum lamp power and a maximum lamp power. A plurality of the inductance-capacitance pairs are thereby calculable using, or are in accordance with, the non-linear model, with the inductance 2 and capacitance 3 of the ballast 1 being one of the inductance-capacitance pairs such that the lamp 4 operates between the minimum and maximum lamp powers.

Furthermore, at a predetermined lamp power, a plurality of the inductance-capacitance pairs are calculable using the non-linear model, and the inductance 2 and the capacitance 3 is one of the inductance-capacitance pairs such that the lamp 4 operates at the predetermined lamp power.

Thus, a plurality of sets of the inductance-capacitance pairs are calculable using the non-linear model with each set corresponding to one of the lamp powers between the minimum and maximum lamp powers, the inductance 2 and capacitance 3 being one of the inductance-capacitance pairs such that the lamp 4 operates between the minimum and maximum lamp powers.

Figure 4:
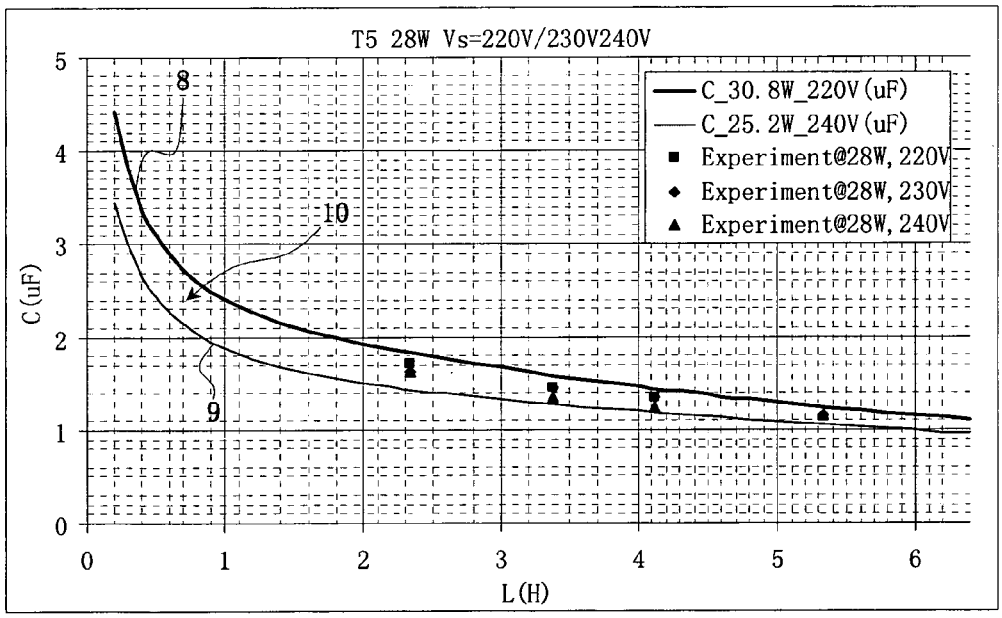
FIG. 4 is a graph showing the inductances and capacitances calculated for the lamp powers indicated in accordance with an embodiment of the present invention.

Based on the above, for an embodiment where the lamp 4 is a T5 28 W lamp, and having the LC ballast circuit shown in FIG. 1, the region of the values of L and C for the LC ballast 1 within which the power of the T5 28 W lamp will be kept within +/−10% of the rated power of 28 W is shown in FIG. 4. That is to say, the predetermined lamp power is between a minimum lamp power of 90% of the rated power and a maximum of 110% of the rated power. Each point in the region defines an inductance and a respective capacitance, thereby defining an inductance-capacitance pair that results in the power being within the minimum and maximum powers defined above. In particular, the upper curve 8 refers to the LC values, or inductance-capacitance pairs, that ensure that the lamp power is 110% (30.8 W) of the rated power of 28 W. Thus, the upper curve represents the set of inductance-capacitance pairs corresponding to 110% of the rated power. The lower curve 9 refers to the set of LC values, or set of inductance-capacitance pairs, that lead to 90% (25.2 W) of the rated power.

Several pairs of L and C values that produce the rated lamp power of 28 W at AC mains of 220V, 230V and 240V (50 Hz) have been recorded and are plotted in FIG. 4. These measurements confirm that the physical model is accurate. The measured points fall in the middle region 10 within the upper (110%) and lower (90%) curves 8 and 9.

Figure 5:
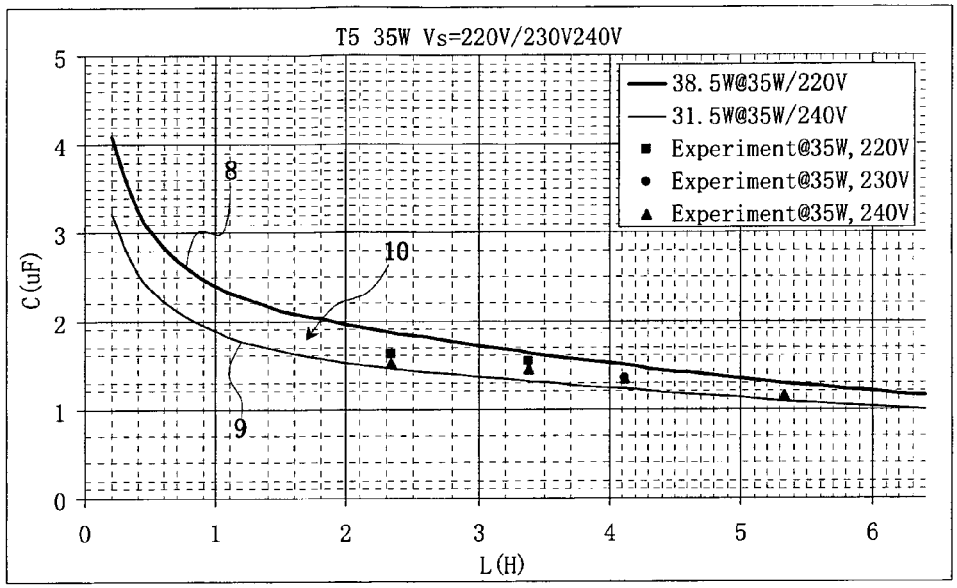
FIG. 5 is a graph showing the inductances and capacitances calculated for the lamp powers indicated in accordance with another embodiment of the present invention.

The same exercise has been conducted for T5 35 W lamps. FIG. 5 shows the upper and lower curves 8 and 9, representing 110% and 90% respectively, of another embodiment where the lamp 4 is a T5 lamp with a rated power of 35 W. Experimental results of several pairs of LC values, at which rated lamp power of 35 W are achieved, are plotted in FIG. 5. Again, these results practically confirm that the non-linear model described above is accurate.

As mentioned above, in FIG. 4 and FIG. 5, each point between the upper and lower curves 8 and 9 corresponds to a pair of L and C values, that is, an inductance-capacitance pair. This means that as long as the ballast inductance 2 and capacitance 3 are selected in accordance with an inductance-capacitance pair defined in the region 10 between the upper and lower curves 8 and 9, the lamp power can be guaranteed to be within 10% of the rated power.

Thus, the present invention allows the selection of regions of LC values within which discharge lamps can operate at or near their rated power. T5 high-efficiency (T5-HE) lamps have a unique feature that their rated current is identical, typically being 0.175 A. For the same lamp tube diameter, the lamp voltage is roughly proportional to the length of the lamps.

The passive LC ballast 1 of the invention can be manufactured for use with any one of a plurality of high voltage discharge lamps 4, with the minimum and maximum lamp powers of the lamps defining one or more common inductance-capacitance pairs, and the inductance 2 and the capacitance 3 of the ballast being one of the common inductance-capacitance pairs such that, when the passive LC ballast is used with any one of the lamps, the lamp operates between the respective minimum and maximum lamp powers of the lamp.

The plurality of lamps 4 can include lamps having different rated powers such that the same passive LC ballast 1 can be used with any one of the lamps. In one preferred embodiment, the rated powers are two or more of 14 W, 21 W, 28 W and 35 W. In another preferred embodiment, the plurality of lamps 4 includes four lamps having rated powers of 14 W, 21 W, 28 W and 35 W respectively. The lamps are preferably T5 fluorescent lamps.

Figure 7:
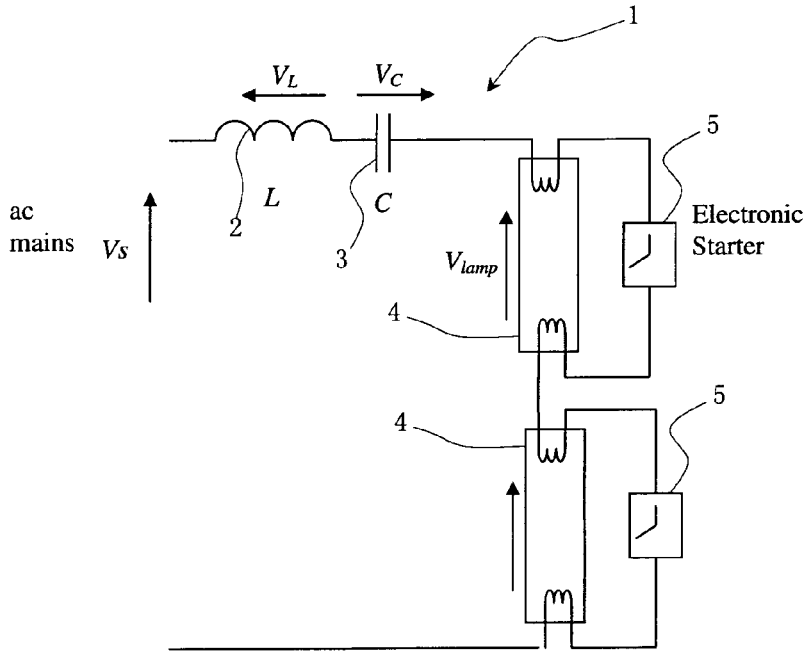
FIG. 7 is a circuit diagram of a circuit in which two lamps connected in series are driven by one passive LC ballast in accordance with an embodiment of the invention.

The passive LC ballast 1 can also be manufactured for use with a plurality of high voltage discharge lamps 4 interconnected in series, with each lamp operating at respective individual predetermined lamp powers, the sum of which equals the predetermined lamp power. FIG. 7 shows one embodiment.

Figure 6:
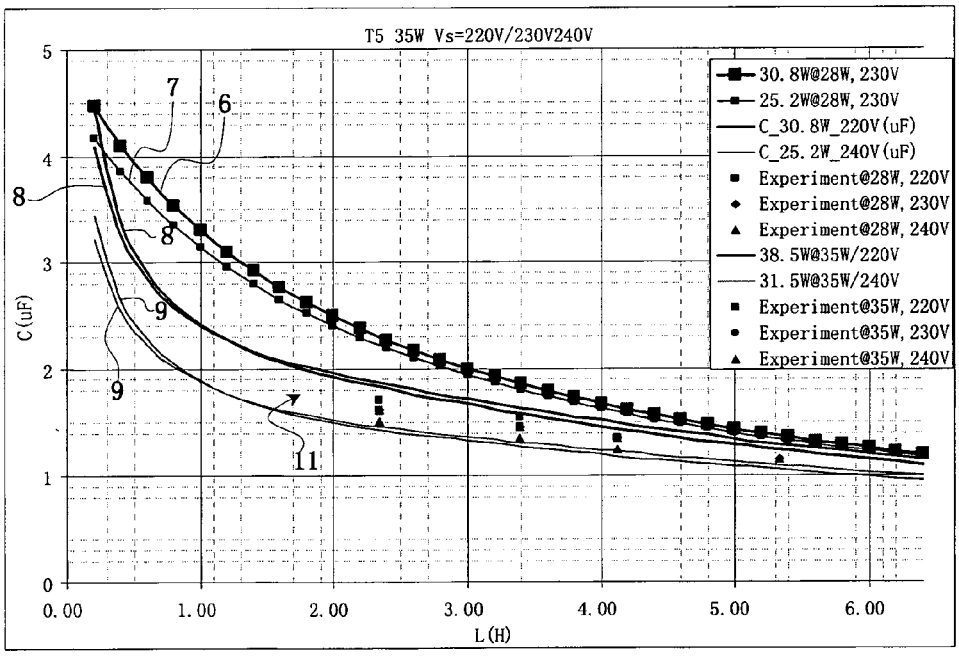
FIG. 6 is a graph combining the graphs of FIGS. 3, 4 and 5.

FIG. 6 combines the graphs of FIG. 3 (showing linear circuit analysis for T5 28 W lamps), FIG. 4 (showing non-linear physical model analysis according to the invention for T5 28 W lamps) and FIG. 5 (showing non-linear physical model analysis for T5 35 W lamps). Several observations are evident from FIG. 6 as follows:

(i) with the measurements of rated lamp power plotted in the same graph, it is clear that the prediction of the linear circuit model is not accurate;

(ii) the non-linear physical model is accurate for both T5 28 W and 35 W lamps;

(iii) the upper curves 8 (110% rated power) of both T5 28 W and 35 W lamps almost overlap;

(iv) the lower curves 9 (90% rated power) of both T5 28 W and 35 W essentially overlap; and (v) the measured LC values at which the rated power occur for 28 W and 35 W lamps also overlap.

These observations lead to several important conclusions:

(a) Observations (iii) and (iv) mean that T5 28 W and 35 W lamps share almost the same region of LC for rated lamp power within +/−10%. This region can be termed the "shared LC region" 11 which contains common inductance-capacitance pairs.

(b) Observation (v) means that the same pair of LC values, that is, the same inductance-capacitance pair, for the LC ballast can be used for both T5 28 W and 35 W lamps. Thus, if properly designed with the LC values chosen within the "shared LC region", that is, the LC values are in accordance with one of the common inductance-capacitance pairs, the one LC ballast product can be used for both T5 28 W and T5 35 W lamps. More generally, one group of LC values can work for both T5 28 W lamps and T5 35 W lamps. This means that the same ballast can be used for both 28 W and 35 W lamps, which are the most popular T5 lamp types on the lighting market.

(c) Since the same pair of LC values can be used for both 28 W and 35 W lamps, the same one LC ballast can also be used for driving series-connected lamps when the sum total power of the lamps is equal to 28 W or 35 W. FIG. 7 shows an example of such a circuit. For example, the same one LC ballast can drive:

(i) one T5 28 W lamp, (ii) one T5 35 W lamp, (iii) two T5 14V lamps connected in series; or (iv) one T5 14 lamp in series with one T5 21 W lamp.

Figure 8:
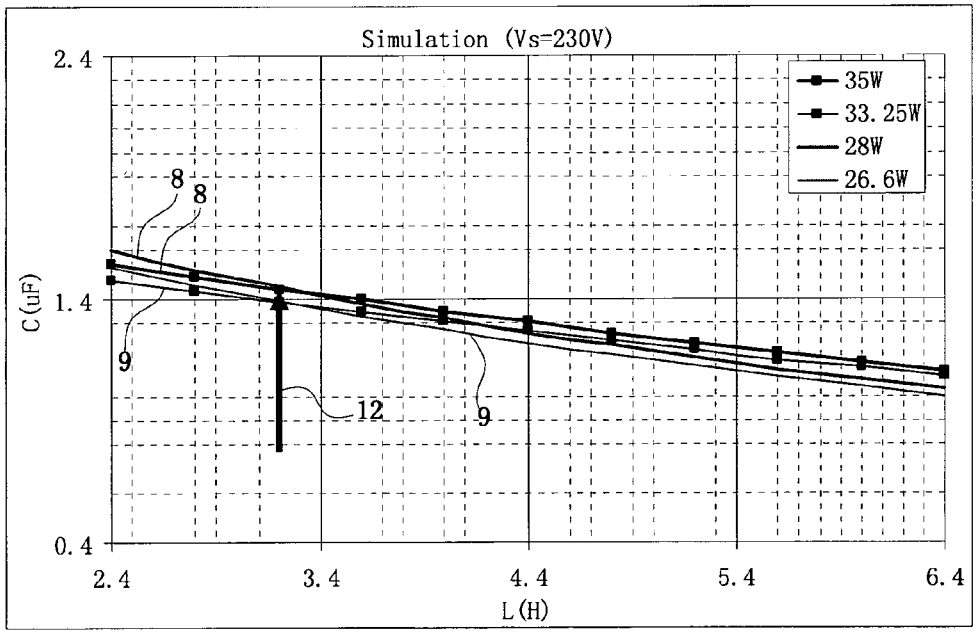
FIG. 8 is a graph showing the inductances and capacitances calculated for the lamp powers indicated in accordance with a further embodiment of the present invention.

FIG. 8 shows the LC values for another preferred embodiment in which a smaller tolerance in lamp power is desired. According to this embodiment, the upper curve 8 is set for the rated power (100%) of both T5 28 W and T5 35 W lamps, and the lower curve 9 is set for 95% of the rated power. Similar to above, FIG. 8 shows that the regions 10 of the 28 W and 35 W lamps intersect to define a "shared LC region" 11. As an example, if the inductance 2 is selected as L=3.2H and the capacitance 3 is selected as C=1.45 uF, as indicated by an arrow 12 in FIG. 8, the pair of LC values can be used for a single design for T5 28 W and 35 W lamps, and a combination of series-connected T5 lamps with total lamp power equal to 28 W and 35 W (as explained previously). One experimental prototype based on these LC values has been built. Performance measurements of this prototype are recorded in Table 1.

TABLE 1

| Lamp Type | Input Voltage(V) | Input Current(mA) | Power factor | Lamp Voltage(V) | Lamp Current(mA) | Lamp Power(W) | Efficiency |
|---|---|---|---|---|---|---|---|
| T5-28W | 230 | 208.68 | 0.645 | 176.11 | 208.68 | 28.3 | 91.2 |
| T5-28W | 220 | 198.42 | 0.679 | 177.9 | 198.42 | 27.16 | 91.5 |
| T5-35W | 230 | 206.27 | 0.795 | 231.74 | 206.27 | 35.07 | 92.68 |
| T5-35W | 220 | 193.25 | 0.83 | 235.03 | 193.25 | 33.26 | 93 |

Figure 9A:
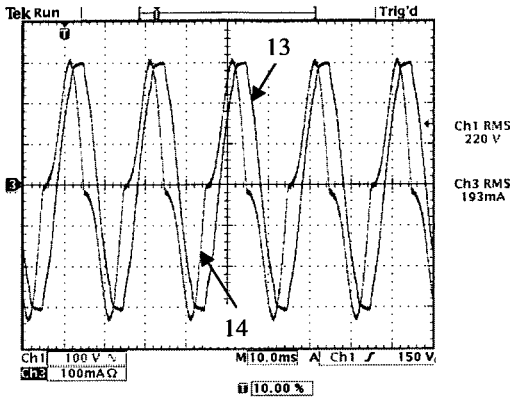
FIG. 9*a* is a graph showing the input AC voltage and input AC current of a circuit including a T5 28 W fluorescent lamp and a passive LC ballast in accordance with an embodiment of the invention, with the lamp driven at full power.
Figure 9B:
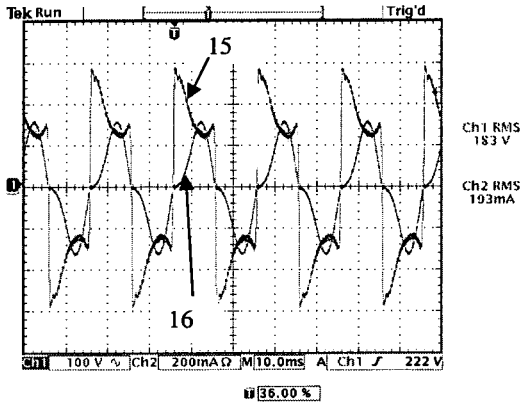
FIG. 9*b* is a graph showing the lamp voltage and the lamp current for the same circuit referred to by FIG. 9*a;*
Figure 10A:
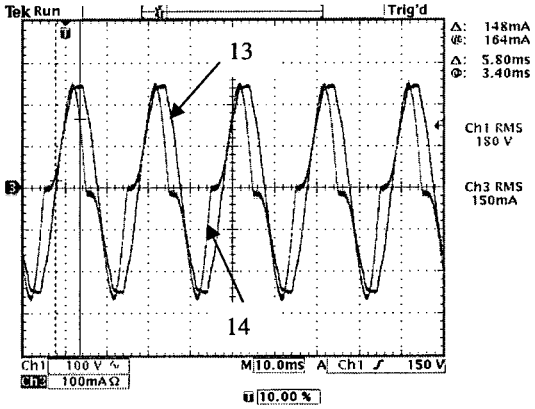
FIG. 10*a* is a graph showing the input AC voltage and input AC current of a circuit including a T5 28 W fluorescent lamp and a passive LC ballast in accordance with another embodiment of the invention, with the lamp driven at 20 W.
Figure 10B:
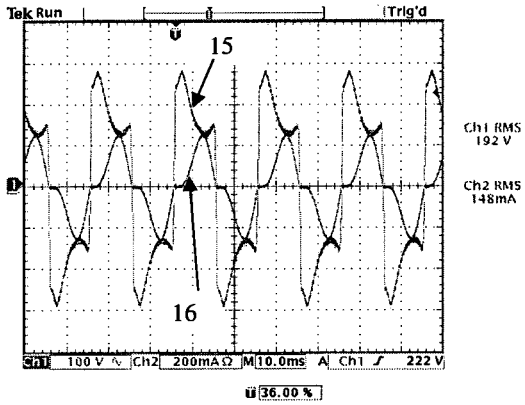
FIG. 10*b* is a graph showing the lamp voltage and the lamp current for the same circuit referred to by FIG. 10*a*.

This represents an ultra-low-loss embodiment of the inductor-capacitor magnetic ballast 1. This embodiment has been applied to a 28 W T5 lamp. The experimental results are shown in FIG. 9 for full power operation at input voltage of 230V, and in FIG. 10 for dimming operation at 180V. In FIGS. 9 and 10, the input AC voltage is marked as 13, the input AC current is marked as 14, the lamp voltage is marked as 15, and the lamp current is marked as 16. The system luminous efficacy of this ultra-low-loss magnetic ballast 1 has been measured and compared with that of an electronic ballast for the same T5 28 W lamp. The results are shown in Table 2 below.

TABLE 2

| For T5 (28 W) lamps At 230 V | Total System Power (W) | Lamp Power (W) | Ballast Loss (W) | Luminous Flux (Lumen) | System Efficacy (Lumen/Watt) |
|---|---|---|---|---|---|
| Electronic ballast (European) | 32.12 | 27.70 | 4.42 | 2338 | 72.79 |
| New LC magnetic ballast (present invention) | 29.65 | 26.75 | 2.90 | 2285 | 77.07 |

The results show that the T5 lamp system with the magnetic ballast 1 has higher efficacy than the T5 lamp system with the electronic ballast. The loss of the magnetic ballast 1 is only 2.9 W which is much less than the 4 W limit for Class A2 energy-efficient ballasts, while the electronic ballast loss is 4.42 W which is of Class A3 type. Despite the fact that high-frequency operation enables about 10% more luminous output from fluorescent lamps, the system efficacy of this system, employing the ultra-low-loss ballast 1 according to the present invention, is 77 lm/W which is higher than that of the electronic ballast system (72 lm/W).

In another aspect, the present invention provides a passive LC ballast for use with any one of a plurality of high voltage discharge lamps each having a respective minimum lamp power and a respective maximum lamp power. The passive LC ballast has an inductance and a capacitance selected in accordance with one of a set of one or more inductance-capacitance pairs. Each inductance-capacitance pair in the set defines a respective inductance and a respective capacitance such that, when the inductance and the capacitance of the passive LC ballast is selected in accordance with any one of the inductance-capacitance pairs and the passive LC ballast is used with any one of the lamps, the lamp operates between the respective minimum and maximum lamp powers of the lamp.

A preferred embodiment of this aspect is the passive LC ballast 1 described in detail above. Thus, in this embodiment, the passive LC ballast has the inductance 2 and the capacitance 3 in accordance with the non-linear model as described above. The set of one or more inductance-capacitance pairs thereby comprises the common inductance-capacitance pairs referred to above.

In a further aspect, the invention provides a method of manufacturing a passive LC ballast for use with any one of a plurality of high voltage discharge lamps each having a respective minimum lamp power and a respective maximum lamp power. The passive LC ballast has an inductance and a capacitance. In particular, the method includes providing a set of one or more inductance-capacitance pairs. Each inductance-capacitance pair in the set defines a respective inductance and a respective capacitance such that, when the inductance and the capacitance of the passive LC ballast is selected in accordance with any one of the inductance-capacitance pairs and the passive LC ballast is used with any one of the lamps, the lamp operates between the respective minimum and maximum lamp powers of the lamp.

A preferred embodiment of this method is manufacturing the passive LC ballast 1 described in detail above. Thus, in this embodiment, the inductance 2 and the capacitance 3 are selected and the set of one or more inductance-capacitance pairs defined in this method comprises the common inductance-capacitance pairs referred to above.

Advantageously, the invention allows a set of one or more inductance-capacitance pairs to be defined. These can then be provided to others who can then simply select the inductance and capacitance for a passive LC ballast in accordance with one of the inductance-capacitance pairs so that when the ballast is used with any one of the plurality of lamps, the lamp operates between the respective minimum and maximum lamp powers of the lamp.

Referring to the above embodiments, the set of one or more inductance-capacitance pairs are represented by the common inductance-capacitance pairs or the "shared LC region" 11 depicted in the figures. Therefore, a graph such as the one shown in FIG. 6 that illustrates a "shared LC region" 11 can be provided to others so that a common inductance-capacitance pair from the set defined by the "shared LC region" can be selected to ensure that the when the ballast 1 is used with any one of the plurality of lamps 4, the lamp 4 operates between the respective minimum and maximum lamp powers of the lamp.

Traditionally, electronic ballasts have been thought to be more energy efficient than magnetic ballasts. However, this situation is no longer true for high-voltage lamps such as T5 fluorescent lamps. For example, previous low-voltage T8 36 W fluorescent lamps had lamp voltages of about 104V and lamp currents of 0.4 A. For high-voltage T5 28 W lamps, lamp voltages are about 175V and lamp currents are 0.17 A. It can be observed that high-voltage lamps tend to have low current ratings for a given power. This feature in fact favors the use of magnetic ballasts in accordance with the present invention because the $i^2R$ conduction loss of the magnetic choke (which is proportional to the square of the lamp current) is substantially reduced for high-voltage, low-current lamps. In the examples of T8 36 W lamps and T5 28 W lamps, the conduction loss in the magnetic ballast (choke) of a T5 28 W system is over 75% less than that of the T8 36 W system. Therefore, electronic ballasts have relatively high power loss and relatively low energy efficiency for high-voltage low-current lamps. Thus, the new LC magnetic ballast systems of the present invention, at least for T5 lamps, can be more energy efficient than electronic ballasts.

Unlike electronic ballasts with relatively short lifetimes of typically 3 to 5 years, LC magnetic ballast systems in accordance with the present invention have no electrolytic capacitor, and therefore, can last for over 15 years without replacement. Since the systems can have magnetic chokes made of recyclable laminated steel, they can also be recycled after their long lifetimes. Therefore, the present invention can ameliorate the rising problem of electronic waste due to the use of electronic ballasts. Therefore, the invention proposed here is more environmentally friendly than electronic ballast technology. The present invention also provides LC ballasts that are well suited for mass production, and new methodologies for designing high voltage lamps using such LC ballasts.

In summary, a magnetic ballast system employing an ultra-low-loss ballast in accordance with the present invention has the following advantages over electronic ballast systems:

(i) lower ballast loss;

(ii) higher system efficacy;

(iii) longer lifetime (e.g. >10 years);

(iv) over 90% of the material used in the ballast can be recyclable;

(v) no toxic components in the ballast;

(vi) low maintenance cost;

(vii) higher reliability;

(viii) lower overall cost; and (ix) one ballast design for a range of lamps and a combination of series-connected lamps.

Although the invention has been described with reference to specific examples, it will be appreciated by those skilled in the art that the invention can be embodied in many other forms. It will also be appreciated by those skilled in the art that the features of the various examples described can be combined in other combinations.

The invention claimed is:

1. A passive LC ballast for use with a high voltage discharge lamp comprising an inductor and a capacitor connected in series with the inductor, wherein the inductor and the capacitor are arranged to define an inductance-capacitance pair having an inductance and a capacitance selected in accordance with an inductance-capacitance relationship based on the following equations:

$$\frac{dT_e}{dt} = a_1(i^2R - P_{con} - P_{rad});$$

$$P_{rad} = a_2\exp(-ea_3/kT_e);$$

$$P_{con} = a_4(T_e - T_0);$$

$$R = a_5T_e^{-3/4}\exp(ea_6/2kT_e);$$

$$V(t) = a_7L\frac{di}{dt} + i(R + r) + V_c + v_{ele};$$

and

-continued $$\frac{dV_c}{dt} = \frac{i}{C};$$

wherein $T_e$ is the electron temperature;
i is the lamp current;
R is the lamp resistance;
$P_{con}$ the thermal conduction loss in the lamp;
$P_{rad}$ is the radiation loss in the lamp;
$T_0$ is the tube temperature;
k is the Boltzmann constant;
e is the charge on an electron;
V(t) is the power supply voltage;
L is the ballast inductance;
C is the ballast capacitance;
r is the ballast resistance;
$V_{ele}$, is the electrode voltage drop in the lamp;
$V_c$ is the voltage across the capacitor in the LC ballast; and
$a_1$ to $a_7$ are coefficients in accordance with an evolutionary algorithm;
such that the lamp operates at a predetermined lamp power.

2. A passive LC ballast according to claim 1 wherein the evolutionary algorithm is a genetic algorithm.

3. A passive LC ballast according to claim 1 wherein a plurality of the inductance-capacitance pairs are in accordance with the non-linear model, the inductance and the capacitance being one of the inductance-capacitance pairs such that the lamp operates at the predetermined lamp power.

4. A passive LC ballast according to claim 1 wherein the predetermined lamp power is any one of the lamp powers between a minimum lamp power and a maximum lamp power, a plurality of the inductance-capacitance pairs are thereby in accordance with the non-linear model, the inductance and capacitance being one of the inductance-capacitance pairs such that the lamp operates between the minimum and maximum lamp powers.

5. A passive LC ballast according to claim 4 wherein a plurality of sets of the inductance-capacitance pairs are in accordance with the non-linear model with each set corresponding to one of the lamp powers between the minimum and maximum lamp powers, the inductance and capacitance being one of the inductance-capacitance pairs such that the lamp operates between the minimum and maximum lamp powers.

6. A passive LC ballast according to claim 4 wherein the lamp has a rated lamp power, the minimum lamp power being about 90% of the rated lamp power and the maximum lamp power being about 110% of the rated lamp power.

7. A passive LC ballast according to claim 4 wherein the lamp has a rated lamp power, the minimum lamp power being about 95% of the rated lamp power and the maximum lamp power being about 100% of the rated lamp power.

8. A passive LC ballast according to claim 4 wherein the passive LC ballast is for use with any one of a plurality of the high voltage discharge lamps, the minimum and maximum lamp powers of the lamps defining one or more common inductance-capacitance pairs, the inductance and the capacitance being one of the common inductance-capacitance pairs such that, when the passive LC ballast is used with any one of the lamps, the lamp operates between the respective minimum and maximum lamp powers of the lamp.

9. A passive LC ballast according to claim 1 wherein the passive LC ballast is for use with a plurality of the high voltage discharge lamps interconnected in series, each lamp operating at respective individual predetermined lamp powers, the sum of which equals the predetermined lamp power.

10. A passive LC ballast according to claim 1 wherein the lamp is a T5 fluorescent lamp.

11. A passive LC ballast according to claim 1 wherein the lamp has a rated power of one of 14 W, 21 W, 28 W and 35 W.

12. A passive LC ballast according to claim 1 wherein the lamp is a T5 fluorescent lamp with a rated power of one of 14 W, 21 W, 28 W and 35 W.

13. A passive LC ballast according to claim 8 wherein the plurality of lamps includes lamps having different respective minimum and maximum lamp powers.

14. A passive LC ballast according to claim 8 wherein the plurality of lamps includes lamps each having a different respective rated lamp power and respective minimum and maximum lamp powers proportional to the respective rated lamp power.

15. A passive LC ballast according to claim 14 wherein the different rated lamp powers are two or more of 14 W, 21 W, 28 W and 35 W.

16. A passive LC ballast according to claim 14 wherein the plurality of lamps includes four lamps having rated lamp powers of 14 W, 21 W, 28 W and 35 W respectively.

17. A passive LC ballast according to claim 13 wherein the lamps are T5 fluorescent lamps.

18. A passive LC ballast according to claim 1 including an inductor having the inductance.

19. A passive LC ballast according to claim 1 including a capacitor having the capacitance.

20. A method of manufacturing a passive LC ballast for use with a high voltage discharge lamp, the method including providing the passive LC ballast with an inductance and a capacitance calculated using a non-linear model such that the lamp operates at a predetermined lamp power, the inductance and the capacitance thereby defining an inductance-capacitance pair; wherein the non-linear model is based on the following equations:

$$\frac{dT_e}{dt} = a_1(i^2R - P_{con} - P_{rad});$$

$$P_{rad} = a_2\exp(-ea_3/kT_e);$$

$$P_{con} = a_4(T_e - T_0);$$

$$R = a_5T_e^{-3/4}\exp(ea_6/2kT_e);$$

$$V(t) = a_7L\frac{di}{dt} + i(R + r) + V_c + v_{ele};$$

and $$\frac{dV_c}{dt} = \frac{i}{C};$$

wherein $T_e$ is the electron temperature;
i is the lamp current;
R is the lamp resistance;
$P_{con}$ is the thermal conduction loss in the lamp;
$P_{rad}$ is the radiation loss in the lamp;
$T_0$ is the tube temperature;
k is the Boltzmann constant;
e is the charge on an electron;
V(t) is the power supply voltage;
L is the ballast inductance;
C is the ballast capacitance;
r is the ballast resistance;
$V_{ele}$, is the electrode voltage drop in the lamp;
$V_c$ is the voltage across the capacitor in the LC ballast; and
$a_1$ to $a_7$ are coefficients in accordance with an evolutionary algorithm.

21. A passive LC ballast for use with any one of a plurality of high voltage discharge lamps each having a respective minimum lamp power and a respective maximum lamp power, the passive LC ballast having an inductance and a capacitance selected in accordance with one of a set of one or more inductance-capacitance pairs, each inductance-capacitance pair defining a respective inductance and a respective capacitance such that, when the inductance and the capacitance of the passive LC ballast is selected in accordance with any one of the inductance-capacitance pairs and the passive LC ballast is used with anyone of the lamps, the lamp operates between the respective minimum and maximum lamp powers of the lamp; wherein the selection of the inductance and the capacitance is based on the following equations:

$$\frac{dT_e}{dt} = a_1(i^2R - P_{con} - P_{rad});$$

$$P_{rad} = a_2\exp(-ea_3/kT_e);$$

$$P_{con} = a_4(T_e - T_0);$$

$$R = a_5T_e^{-3/4}\exp(ea_6/2kT_e);$$

$$V(t) = a_7L\frac{di}{dt} + i(R + r) + V_c + v_{ele};$$

and $$\frac{dV_c}{dt} = \frac{i}{C};$$

wherein $T_e$ is the electron temperature;
i is the lamp current;
R is the lamp resistance;
$P_{con}$ is the thermal conduction loss in the lamp;
$P_{rad}$ is the radiation loss in the lamp;
$T_0$ is the tube temperature;
k is the Boltzmann constant;
e is the charge on an electron;
V(t) is the power supply voltage;
L is the ballast inductance;
C is the ballast capacitance;
r is the ballast resistance;
$V_{ele}$, is the electrode voltage drop in the lamp;
$V_c$ is the voltage across the capacitor in the LC ballast; and
$a_1$ to $a_7$ are coefficients in accordance with an evolutionary algorithm.

22. A method of manufacturing a passive LC ballast for use with anyone of a plurality of high voltage discharge lamps each having a respective minimum lamp power and a respective maximum lamp power, the passive LC ballast having an inductance and a capacitance, and the method including providing a set of one or more inductance-capacitance pairs, each inductance-capacitance pair defining a respective inductance and a respective capacitance such that, when the inductance and the capacitance of the passive LC ballast is selected in accordance with anyone of the inductance-capacitance pairs and the passive LC ballast is used with anyone of the lamps, the lamp operates between the respective minimum and maximum lamp powers of the lamp; wherein the selection of the inductance and the capacitance is based on the following equations:

$$\frac{dT_e}{dt} = a_1(i^2R - P_{con} - P_{rad});$$

$$P_{rad} = a_2\exp(-ea_3/kT_e);$$

$$P_{con} = a_4(T_e - T_0);$$

$$R = a_5T_e^{-3/4}\exp(ea_6/2kT_e);$$

$$V(t) = a_7L\frac{di}{dt} + i(R + r) + V_c + v_{ele};$$

and $$\frac{dV_c}{dt} = \frac{i}{C};$$

wherein $T_e$ is the electron temperature;
i is the lamp current;
R is the lamp resistance;
$P_{con}$ is the thermal conduction loss in the lamp;
$P_{rad}$ is the radiation loss in the lamp;
$T_0$ is the tube temperature;
k is the Boltzmann constant;
e is the charge on an electron;
V(t) is the power supply voltage;
L is the ballast inductance;
C is the ballast capacitance;
r is the ballast resistance;
$V_{ele}$, is the electrode voltage drop in the lamp;
$V_c$ is the voltage across the capacitor in the LC ballast; and
$a_1$ to $a_7$ are coefficients in accordance with an evolutionary algorithm.

* * * * *